US006513180B2

(12) United States Patent
Hamand

(10) Patent No.: US 6,513,180 B2
(45) Date of Patent: Feb. 4, 2003

(54) WASHING MACHINE INCORPORATING A BLEACH ACTIVATOR

(75) Inventor: Michael A. Hamand, Newton, IA (US)

(73) Assignee: Maytag Corporation, Newton, IA (US)

( * ) Notice: Subject to any disclaimer, the term of this patent is extended or adjusted under 35 U.S.C. 154(b) by 121 days.

(21) Appl. No.: 09/851,581

(22) Filed: May 10, 2001

(65) Prior Publication Data

US 2002/0166177 A1 Nov. 14, 2002

(51) Int. Cl.[7] ..... D06F 39/00
(52) U.S. Cl. ..... 8/158; 68/13 R
(58) Field of Search ..... 8/158, 159; 68/13 R

(56) References Cited

U.S. PATENT DOCUMENTS

| | | | |
|---|---|---|---|
| 3,130,570 | A | 4/1964 | Rentzepis |
| 3,338,839 | A | 8/1967 | MacKellar et al. |
| 4,188,807 | A | 2/1980 | Graf et al. |
| 4,481,086 | A | 11/1984 | Bianchi et al. |
| 5,068,937 | A | 12/1991 | Meloni et al. |
| 5,211,689 | A | 5/1993 | Kobayashi |
| 5,309,739 | A | 5/1994 | Lee |
| 5,345,637 | A | 9/1994 | Pastryk et al. |
| 5,703,034 | A | 12/1997 | Offshack et al. |
| 5,765,403 | A | 6/1998 | Lincoln et al. |
| 5,794,290 | A | 8/1998 | Roberts |
| 5,881,412 | A | 3/1999 | Ziskind |
| 5,978,994 | A | 11/1999 | Anderson |
| 5,978,995 | A | 11/1999 | Bruntz et al. |

FOREIGN PATENT DOCUMENTS

JP 3112594 5/1991

OTHER PUBLICATIONS

Hage et al., "Efficient Manganese Catalysts for Low–Temperature Bleaching", Letters to Nature, vol. 369, pp. 637–639, Jun. 23, 1994.

Reinhardt, Gerd, "New Bleach Systems: In Search of Greater Cost–Effectiveness", pp. 195–203, 1998.

*Primary Examiner*—Philip Coe
(74) *Attorney, Agent, or Firm*—Diederiks & Whitelaw, PLC

(57) ABSTRACT

A washing machine including an metal-containing bleach activation system and method of operation are disclosed herein. A peroxide generator, in the form of an electrochemical cell, is connected to a water inlet pipe to produce and deliver peroxide molecules into the washing machine. The activation system includes a catalyst which is preferably compounded into structure of the machine, such that when soiled articles contact the peroxide and the catalyst, the bleaching activity of the peroxide is greatly increased.

21 Claims, 1 Drawing Sheet

WASHING MACHINE INCORPORATING A BLEACH ACTIVATOR

BACKGROUND OF THE INVENTION

1. Field of the Invention

The present invention relates to the art of washing machines. Specifically, the washing machine of the invention includes a bleach activator such that, when a bleaching agent is added to the washing machine which has been loaded with soiled articles, the bleach activator will enhance the cleaning activity of the added bleach. An electrochemical cell is used to generate a peroxide from water and air to be used as a bleaching agent.

2. Discussion of the Prior Art

Since the advent of the automatic washing machine, it has been known to use chemicals such as bleaches to aid in the cleaning of soiled articles. Commonly used are chlorine bleaches, in powder or liquid form, which are poured onto the articles during a washing procedure. The bleach may also be used as a prewash to assist in the removal of stains and general laundering.

However, it has been discovered that the use of chlorine bleach, while being extremely toxic to humans, can also leave articles with a yellow tint. As a result, the use of hydrogen peroxide ($H_2O_2$) has been discovered to be safer to both humans and articles. U.S. Pat. No. 3,130,570 to Rentzepis discloses the use of hydrogen peroxide, diatomic oxygen ($O_2$) and ozone ($O_3$) to provide a bleaching result during a laundry cycle. In this system, hydrogen peroxide and ozone are automatically added by the dissociation of air in water, via the action of an electrochemical cell.

Unfortunately, the bleaching activity of peroxides and other bleaching chemicals is very low at standard washing temperatures. While bleaching soiled articles at a temperature of about 200° F. (95° C.) would generally solve this dilemma, using wash water at such a temperature is both impractical and potentially dangerous. First, a water inlet temperature of near the boiling point of water could severely burn anyone in the vicinity of the washing machine in the event of a leak or overflow. The use of such a high temperature also greatly increases the energy costs required to perform a washing cycle. Additionally, the elevated temperatures would effectively prevent the use of many types of plastic or rubber hoses, as melting would be a problem.

U.S. Pat. No. 4,188,807 to Graf et al. discloses the use of a catalyst to allow bleaching at a lower temperature. The addition of N-acetal-caprolactum as a catalyst serves to increase the activity of a bleaching process at temperatures below about 200° F. (95° C.). Because this catalyst is added to the washing additives (including hydrogen peroxide as a bleaching agent), the temperatures required are lowered to approximately 140° F. (60° C.). While a wash temperature of approximately 140° F. (60° C.) does result in a marked reduction in energy required, most water heaters in American homes are set significantly below this threshold. Furthermore, this system requires the washing additive to include both a catalyst and the bleaching agent when a bleaching action is desired.

As described in Hage et al., "Efficient manganese catalysts at low-temperature bleaching", *Nature*, Vol. 369, Jun. 23, 1994, it is known that a number of manganese complexes derived from 1,4,7-trimethyl-1,4,7-triazacyclononane can be used to increase the bleaching activity of $H_2O_2$. Various tests using $H_2O_2$ at 104° F. (40° C.) have shown that the simple inclusion of the manganese complexes can increase the bleaching activity (a measure of change in reflectance at 460 nm) up to five-fold.

Regardless, there still exists the need in the art to provide a washing machine capable of an improved bleaching action at a safe and practical temperature. Particularly, there exists the need to provide such a system wherein no bleaching chemical needs to be manually added by a user prior to initiating a bleaching cycle.

SUMMARY OF THE INVENTION

The present invention pertains to a washing machine incorporating a bleach activator such that no bleaching agent is required to be added manually during a bleaching operation. In accordance with a preferred embodiment of the invention, the washing machine includes a CPU which operates a peroxide generator, preferably in the form of an electrochemical cell, to dissociate water and air into a peroxide. A control panel disposed on the washing machine itself includes a user selectable element which indicates to the CPU that a bleaching operation is desired. Because the electrochemical cell has a water inlet and a water outlet, when peroxide is generated from water introduced by the water inlet, the electrochemical cell can provide the peroxide to the water outlet which feeds into a wash basket within the washing machine.

In order to increase the activity of the peroxide added to the washing machine, a catalyst is provided. In general, a metal-containing bleach activating catalyst is provided which interacts with the peroxide and allows efficient bleaching at a standard washing temperature. In a preferred embodiment, the catalyst is a manganese-1,4,7-trimethyl-1,4,7-triazacyclononane complex and is compounded into a component of the wash basket. In particular, the catalyst may be included in an agitator, a baffle or any other component which contacts the wash water and soiled articles simultaneously.

In a preferred embodiment, the selectable element on the control panel is used to direct the CPU to direct a voltage flow to the electrochemical cell. In such a system, the selectable element can be a simple two-position switch/button or, in the alternative, a multi-position element for directing a variety of electrical voltages to the electrochemical cell, resulting in a variety of peroxide levels. The selectable element may also be used, via the CPU, to control a solenoid valve. In such a system, the solenoid valve is provided with two positions. In a first or no-bleach position, the valve prevents water from entering the peroxide generator and, in a second position, water is directed to the peroxide generator before entering the wash basket. As a result, different positions of the valve are used to selectively bypass or utilize the peroxide generator.

Additional objects, features and advantages of the present invention will become more filly apparent from the following detailed description of preferred embodiments, when taken in conjunction with the drawing wherein like reference numerals refer to corresponding parts in the several views.

DETAILED DESCRIPTION OF THE PREFERRED EMBODIMENTS

Figure 1:
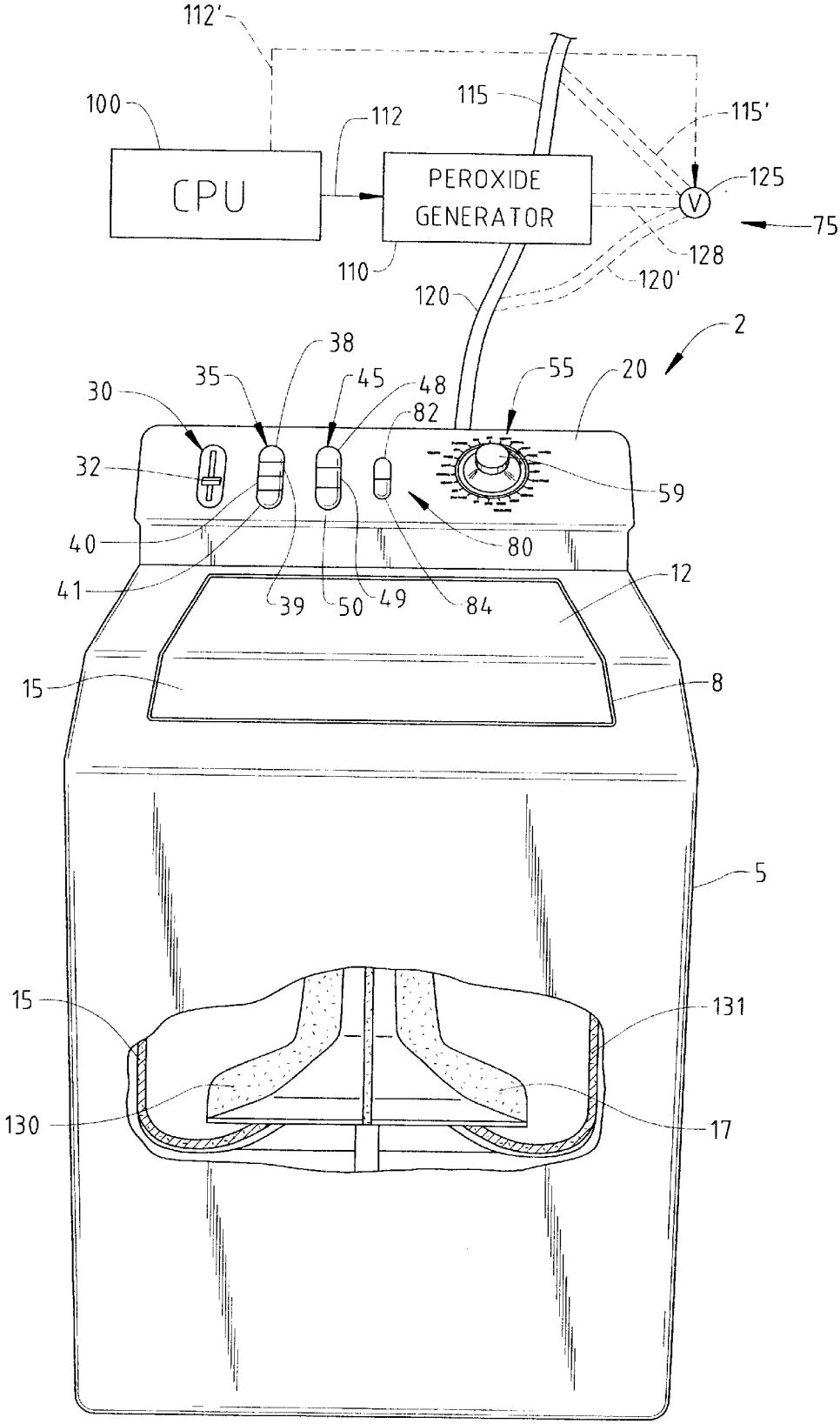
FIG. 1 is a front perspective view of a top loading washing machine incorporating the bleach activating system of the present invention.

An appliance constructed accordance with this invention is depicted in FIG. 1 as a vertical axis washing machine generally indicated at 2. However, the invention is not limited to a vertical axis washing machine, as any automatic bleaching device is considered within the scope of the invention. For example, the invention could be readily employed in a horizontal axis washing machine. The washing machine could also take the form of a carpet cleaning machine. In general, the invention is considered to be applicable to any device used for cleaning and bleaching.

As shown, washing machine 2 includes an outer cabinet 5 provided with an upper opening 8 that can be selectively closed by means of a pivotable lid 12. In a manner widely known in the art, lid 12 can be raised to provide access to a rotatable basket 15 including a central agitator 17 mounted within cabinet 5. In a manner widely known in the art, soiled articles are to be placed in basket 15 to be laundered. In the preferred embodiment shown, lid 12 includes an angled front portion 15 to enhance access to within cabinet 5.

At a rear portion of cabinet 5 is arranged a control panel 20 that includes various control units which can be used to program a desired laundering operation for washing machine 2. It must be noted, however, the specific structure of control panel 20 does not form part of the present invention. In the embodiment shown, control panel 20 includes a first control unit 30 having a vertically shiftable knob 32. Knob 32 is adapted to be shifted between raised and lowered positions in order to enable a user of washing machine 2 to select a desired load size. For instance, knob 32 can be shifted between mini, medium, large and super load capacity positions, as well as a potential reset position. Control panel 20 also includes a second control unit 35 that is defined by a plurality of buttons 38–41. Second control unit 35 is provided to establish wash and rinse temperatures. Therefore, button 38 is used to establish hot/cold wash/rinse temperatures; button 39 is used to establish warm/warm wash/rinse temperatures; button 40 is used to establish warm/cold wash/rinse temperatures; and button 41 is used to establish cold/cold wash/rinse temperatures respectively.

Adjacent second control unit 35 is a third control unit 45 which is defined, in the preferred embodiment shown, by buttons 48–50. Third control unit 45 can be used by a consumer to selectively establish a super wash operation through the use of button 48, the application of a second rinse through button 49, and to cancel either of these control features through button 50.

In addition to these operating parameters, it is also necessary to establish both a desired cycle and operational time for a laundry operation to be per formed within washing machine 2. A fourth control unit 55, shown on control panel 20 includes a control member 59 and preferably takes the form of a rotatable knob, about which various graphic indicia are generally disposed to direct various operations of washing machine 2. Again, in general, the structure described above with respect to washing machine 2 is already known in the art and does not constitute part of the present invention.

FIG. 1 also depicts an automatic bleaching system 75 in accordance with the invention. Positioned on control panel 20, between third control unit 45 and fifth control unit 55, is a bleach selector 80. Bleach selector 80 is shown as including a set of two buttons 82 and 84, corresponding to ON and OFF positions respectively, for controlling operation of the bleaching system 75. A CPU 100 is provided to control both the operation of washing machine 2, including the bleaching system 75, by reading the position of bleach selector 80 and directing the remainder of the bleaching system 75 as detailed herein. More particularly, CPU 100 directs the operation of a peroxide generator 10 via a control line 112. In a preferred embodiment, peroxide generator 110 is an electrochemical cell for dissociating water and air to liberate hydrogen peroxide ($H_2O_2$). However, peroxide generator 10 may take the form of any device capable of providing a bleaching composition, e.g. a receptacle for receiving a manually supplied bleaching additive such as a chemical perborate or carbonate in powder or liquid form. Water enters peroxide generator 110 through a main inlet pipe 115 and exits through a discharge pipe 120. If peroxide generator 110 is activated, peroxide molecules will be added to the water flow into discharge pipe 120.

Although bleach selector 80 is shown as including buttons 82 and 84 for controlling the operation of the bleaching system 75, bleach selector 80 may take on a variety of forms. For example, bleach selector 80 may be in the form of a slideable switch having numerous discreet or infinitely variable positions. In such an embodiment, the relative position of sliding bleach selector 80 can be read by CPU 100 to deliver a corresponding voltage level to peroxide generator 110. Accordingly, slidable bleach selector 80 can be used to vary the voltage delivered to peroxide generator 110 and, as a result, the amount of peroxide produced therein. A rotary knob, as well as other arrangements, could be used to perform corresponding functions as well.

FIG. 1 also shows an alternate embodiment for the bleaching system 75 of the invention in dotted lines. In accordance with this embodiment, CPU 100 controls a solenoid valve 125 via control line 112' for delivery of peroxide into basket 15. Water flows through an inlet pipe 115' and into valve 125. Valve 125 has one position wherein water bypasses peroxide generator 110 and flows directly through discharge pipe 120' to basket 15, and an alternate position wherein water may flow through a different pipe 128 to peroxide generator 110 and finally to basket 15 via discharge pipe 120. CPU 100 controls the position of valve 125 via control line 112'. In this embodiment, control line 112 is still preferably included such that, when valve 125 permits water flow to peroxide generator 110, peroxide generator 110 may be energized. However, control line 112 may be eliminated, with peroxide generator 110 being actuated automatically when water is directed thereto. Although peroxide generator 110, CPU 100 and valve 125, along with their associated pipes 115, 115', 120, 120', 128 and control lines 112 and 112' are shown, outside washing machine 2 for the sake of simplicity, in a preferred embodiment, these structures are integrated into cabinet 5 and are not otherwise visible from outside washing machine 2.

If bleach selector 80 is provided as a slideable element, such as described above, the relative position of bleach selector 80 may be read by CPU 100 to control the position of valve 125. For example, placement of bleach selector 80 in its middle position causes valve 125 to be in an intermediate position, such that generally one-half of the water from inlet pipe 115' flows to peroxide generator 110 via discharge pipe 128, and the other half of the water from inlet pipe 115' flows directly to basket 15 via discharge pipe 120'. Just as in the prior embodiment, the position of bleach selector 80 may be also be used to control the voltage to peroxide generator 110 in combination with valve 125 in a two-position configuration or in a multiple-position configuration.

Once the peroxide, or other bleaching chemical, is added to a wash solution present in basket 15, the peroxide begins to bleach soiled articles. However, as discussed above, this action is highly limited at standard washing temperatures. Therefore, in accordance with this invention a catalyst is provided within washing machine 2 in order to increase the bleaching activity. Any bleach-activating catalyst may be used, however a metal-containing catalyst is preferred. Preferably the catalyst contains manganese and, most preferably, is derived from 1,4,7-trimethyl-1,4,7-triazacyclononane producing a manganese complex. While not wishing to be bound by the following theory, it is believed that the catalyst provides a surface upon which the peroxide molecules bind, such that the bleaching activity of the molecules is increased, just as with elevated wash temperatures.

The catalyst may be provided in a variety of locations inside washing machine 2. For example, in one embodiment, the catalyst is compounded into the agitator 17 as indicated at 130 in FIG. 1. The catalyst could be equally compounded into basket 15 such as indicated at 131. Most preferably, compounding of the catalyst results in the catalyst being part of the plastic structure of basket 15 and/or agitator 17 and distributed therein during molding or formation of the plastic part(s). If, however, washing machine 2 is of a horizontal-axis type, instead of a vertical-axis type as depicted in FIG. 1, the catalyst may be compounded into baffles provided along the periphery of basket 15. In addition, if the various components are not made of plastic, one of more of the components could be spray coated with the catalyst. In any event, as long as the catalyst may contact both the wash solution and articles, preferably simultaneously, any location is sufficient. It is also contemplated to provide the catalyst in a removable medium, such as a dispensing ball, or other similar device placed into basket 15 when a bleaching action is desired.

Although described with reference to preferred embodiments, it should readily understood that various changes and/or modifications could be made to the invention without departing from the spirit thereof. For example, as indicated above, system 75 may be incorporated into other types of washing machines, such as a carpet vacuum cleaner with the peroxide generator delivering peroxide to a catalyst containing brush. It is also considered within the scope of this invention to provide the above-described bleaching system 75 as an add-on to a washing machine not having an integrated bleaching system. In such a situation, depending upon which embodiment is used, one end of peroxide generator 110 (with or without valve 125) is interconnected to inlet pipe 115 and discharge pipe 120 is affixed to another end of peroxide generator 115. Additionally, a basket and/or agitator of a washing machine can be replaced with ones compounded with the catalyst, or the machine can be used with a removable catalyst separately mounted therein. In any event, the invention is only intended to be limited by the scope of the following claims.

I claim:

1. A washing machine comprising:

a housing;

a rotating member disposed within said housing;

means for introducing a bleaching chemical having an activity level into the housing;

a catalyst carried by said rotating member, said catalyst being adapted to contact soiled articles and the bleaching chemical during operation of said washing machine to increase the activity level of the bleaching chemical.

2. The washing machine according to claim 1, wherein said catalyst is integrated into the rotating member.

3. The washing machine according to claim 2, wherein the rotating member is made of plastic and said catalyst is compounded into the rotating member.

4. The washing machine according to claim 1, wherein said bleaching chemical is a peroxide.

5. The washing machine according to claim 4, wherein said introducing means comprises a peroxide generator.

6. The washing machine according to claim 5, wherein said peroxide generator constitutes an electrochemical cell.

7. The washing machine according to claim 4, wherein said catalyst contains a manganese complex.

8. The washing machine according to claim 7, wherein the manganese complex is derived from 1,4,7-trimethyl- 1,4,7-triazacyclononane.

9. The washing machine according to claim 1, wherein said washing machine comprises a clothes washing machine and the soiled articles constitute articles of clothing.

10. The washing machine according to claim 9, further comprising:

a water inlet to the housing;

a control panel including a plurality of selector members for selectively establishing a desired washing operation for said clothes washing machine; and a basket adapted to receive the soiled articles, water from the water inlet and a bleaching chemical from the introducing means, said catalyst being adapted to engage both the articles of clothing and the bleaching chemical, within the basket, during operation of said clothes washing machine.

11. The washing machine according to claim 10, wherein said introducing means comprises a peroxide generator.

12. The washing machine according to claim 11, further comprising: a bleaching selection element disposed on said control panel for selectively controlling said peroxide generator.

13. The washing machine according to claim 12, wherein said peroxide generator constitutes an electrochemical cell and said bleaching selection element is adapted to control a voltage to said electrochemical cell.

14. The washing machine according to claim 11, further comprising: a valve connected to said water inlet, said valve being shiftable to at least a first position wherein water is directed to said peroxide generator and a second position wherein water is directed to bypass said peroxide generator.

15. The washing machine according to claim 10, wherein said rotating member constitutes said basket.

16. The washing machine according to claim 10, further comprising: an agitator movably mounted within the basket, said rotating member being constituted by said agitator.

17. The washing machine of claim 16, wherein said agitator is formed of plastic, said catalyst being compounded into the plastic of the agitator.

18. A method for bleaching articles with a washing machine comprising:

introducing at least water and a bleaching chemical, having an activity level, into the washing machine; and contacting the soiled articles during a washing operation with both the bleaching chemical and a catalyst, carried by a rotating element of the washing machine, which increases the activity level of the bleaching chemical.

19. The method of claim 18, wherein said bleaching chemical is developed and introduced by a peroxide generator.

20. The method of claim 19, wherein the peroxide generator constitutes an electrochemical cell, said method further comprising: adjusting a volume of peroxide by altering a voltage to the electrochemical cell.

21. The method of claim 19, further comprising: shifting a valve to allow water to flow to the peroxide generator.

* * * * *